US008866639B2

(12) United States Patent
Kleindienst et al.

(10) Patent No.: US 8,866,639 B2
(45) Date of Patent: Oct. 21, 2014

(54) KEY UNIT FOR A LOCK SYSTEM OF A VEHICLE

(75) Inventors: Niels Kleindienst, Berlin (DE); Odysseus Andronis, Wolfenbuettel (DE)

(73) Assignee: Volkswagen AG, Wolfsburg (DE)

( * ) Notice: Subject to any disclaimer, the term of this patent is extended or adjusted under 35 U.S.C. 154(b) by 1684 days.

(21) Appl. No.: 12/373,702

(22) PCT Filed: Jul. 10, 2007

(86) PCT No.: PCT/EP2007/006116

§ 371 (c)(1), (2), (4) Date: Dec. 16, 2010

(87) PCT Pub. No.: WO2008/006551

PCT Pub. Date: Jan. 17, 2008

(65) Prior Publication Data

US 2011/0084856 A1 Apr. 14, 2011

(30) Foreign Application Priority Data

Jul. 13, 2006 (DE) ..... 10 2006 032 376

(51) Int. Cl.
*G08G 1/123* (2006.01)
*E05B 19/04* (2006.01)
*G07C 9/00* (2006.01)

(52) U.S. Cl.
CPC ..... *E05B 19/043* (2013.01); *G07C 9/00944* (2013.01)
USPC ..... 340/990; 340/5.7; 70/408

(58) Field of Classification Search
USPC ..... 340/990, 5.7, 5.72; 70/408, 278.3, 456
See application file for complete search history.

(56) References Cited

U.S. PATENT DOCUMENTS

| | | | | |
|---|---|---|---|---|
| 4,941,569 | A | 7/1990 | Lindmayer et al. | |
| 5,561,331 | A * | 10/1996 | Suyama et al. | 307/10.3 |
| 6,392,592 | B1 * | 5/2002 | Johnson et al. | 342/357.75 |
| 6,705,141 | B1 * | 3/2004 | Jacob et al. | 70/408 |
| 6,948,614 | B1 * | 9/2005 | Hall et al. | 206/305 |
| 7,145,507 | B2 * | 12/2006 | Luo et al. | 342/357.34 |
| 7,156,693 | B2 | 1/2007 | Kusaka | |

(Continued)

FOREIGN PATENT DOCUMENTS

| | | |
|---|---|---|
| CN | 2 154 887 | 2/1994 |
| CN | 2 457 280 | 10/2001 |

(Continued)

OTHER PUBLICATIONS

International Search Report, PCT/EP2007/006116 dated Oct. 31, 2007.

(Continued)

*Primary Examiner* — George Bugg
*Assistant Examiner* — Edny Labbees
(74) *Attorney, Agent, or Firm* — Kenyon & Kenyon LLP

(57) ABSTRACT

A key unit for a lock system of a vehicle includes a device for opening and closing a lock system, in particular having a transmitter for the remote control of the lock system and/or a mechanical key. The key unit has a modular design, which includes a key case and an attachment. The key case accommodates the device for opening and closing the lock system. The attachment is releasably joined to the key case and permits various embodiments of the key unit.

36 Claims, 11 Drawing Sheets

(56) References Cited

U.S. PATENT DOCUMENTS

| | | | | |
|---|---|---|---|---|
| 7,290,419 | B2 | 11/2007 | Balko et al. | |
| 7,657,226 | B2 * | 2/2010 | Gisler | 455/41.2 |
| 2002/0175096 | A1 | 11/2002 | Linihan | |
| 2003/0231550 | A1 * | 12/2003 | Macfarlane | 367/198 |
| 2004/0027336 | A1 | 2/2004 | Ishii et al. | |
| 2005/0225429 | A1 * | 10/2005 | Burzio | 340/5.24 |
| 2006/0049915 | A1 | 3/2006 | Deniau et al. | |
| 2006/0170531 | A1 * | 8/2006 | Narayanaswami et al. | 340/5.53 |
| 2008/0150679 | A1 * | 6/2008 | Bloomfield | 340/5.7 |

FOREIGN PATENT DOCUMENTS

| | | |
|---|---|---|
| CN | 1 456 774 | 11/2003 |
| CN | 1 517 826 | 8/2004 |
| CN | 1 521 057 | 8/2004 |
| CN | 2 669 257 | 1/2005 |
| CN | 2 741 088 | 11/2005 |
| CN | 1 717 522 | 1/2006 |
| DE | 38 42 790 | 4/1990 |
| DE | 39 02 537 | 8/1990 |
| DE | 42 26 579 | 2/1994 |
| DE | 102 06 534 | 10/2003 |
| DE | 103 08 900 | 9/2004 |
| DE | 103 18 376 | 11/2004 |
| DE | 20 2005 001 972 | 5/2005 |
| DE | 20 2005 003 610 | 5/2005 |
| DE | 10 2005 043 893 | 5/2006 |
| EP | 1 052 352 | 11/2000 |
| EP | 1 070 813 | 1/2001 |
| EP | 1 280 390 | 1/2003 |
| EP | 1 437 690 | 7/2004 |
| GB | 2 417 926 | 3/2006 |
| JP | 2003-109450 | 4/2003 |
| JP | 2004-036302 | 2/2004 |
| WO | WO 2004/053661 | 6/2004 |

OTHER PUBLICATIONS

International Preliminary Report on Patentability and Written Opinion, PCT/EP2007/006116 dated Feb. 10, 2009. (translated).

Korean Patent Abstracts, Korean Patent Application No. 10 2004 010 7309 filed Dec. 16, 2004.

* cited by examiner

KEY UNIT FOR A LOCK SYSTEM OF A VEHICLE

FIELD OF THE INVENTION

The present invention relates to a key unit for a lock system of a vehicle, having a device for opening and closing the lock system. The device for opening and closing the lock system is, in particular, a pivoting mechanical key, and/or a transmitter for remote control of the lock system.

BACKGROUND INFORMATION

German Published Patent Application No. 38 42 790 and German Published Patent Application No. 39 02 537 describe key cases which accommodate a flat key that can be swung out. Moreover, German Published Patent Application No. 42 26 579 describes a compact transmitter for remote control of a locking device, which additionally includes a swing-out flat key for the mechanical operation of a lock cylinder.

German Published Patent Application No. 10 2005 043 893 describes a key tag, especially for vehicle keys, which includes switching elements and a display window.

German Published Patent Application No. 102 06 534 describes a vehicle key having an electronic key and a mechanical emergency key. The emergency key may be swiveled by a rotary motion from an idle position to a position of use.

European Published Patent Application No. 1 280 390 describes an electronic key having a two-part housing, which is able to accommodate a mechanical key part.

SUMMARY

Example embodiments of the present invention provide a key unit for a lock system of a vehicle, in which the key unit is variably and inexpensively adaptable to various vehicle types and options packages of a vehicle manufacturer. In addition, the functional scope of the key unit is to be expandable.

In the following description, direction indications are used as follows: The top side of the key unit is the side on which operating fields may be manipulated, the bottom side is the side facing away from the top side. The end face of the key unit is perpendicular to the bottom side and points in the direction of a mechanical key which is in a position of use. The lateral surfaces of the key unit are both perpendicular to the top side and bottom side, and perpendicular to the end face. If the key unit includes a mechanical key, the lengthwise direction is the direction in which the key extends in the position of use. The lateral direction extends perpendicular to the lengthwise direction. The height or thickness of the key unit extends perpendicular to the lengthwise direction and lateral direction and is the shortest expanse of the key unit.

According to example embodiments of the present invention, a key unit is provided, which includes a modular design that includes a key case, which accommodates the device for opening and closing the lock system, and an attachment which is releasably joined to the key case. The modular design makes it possible to assign to the key case various attachments, which may be adapted according to the desires of the vehicle manufacturer or the customer of the vehicle manufacturer. In so doing, it is not necessary to alter the key case for the various formations of the attachment. It is possible to vary a basic key unit in a variety of manners. In this manner, different variants of the key unit may be produced inexpensively.

The attachment may be joined in rotatably fixed fashion to the key case. In addition or alternatively, the attachment may be joined in alignment with the key case. In so doing, the outer shell of the attachment merges, preferably in alignment, into the outer shell of the key case, so that a compact unit is created between the key case and the attachment. In particular, the key case and the attachment may have surfaces adjacent to each other. A secure coupling may thereby be produced between the key case and the attachment. The attachment may be secured to the key case by a snap-in connection.

The key case may be arranged in one piece. Therefore, an encasing arrangement is provided for the key case, in which the key case may be produced from plastic by injection molding using only one tool. The form of the key case may be produced inexpensively in this manner. In particular, the key case includes an upper form and a lower form, which are joined to each other by a film hinge. When the upper form and lower form lie one upon the other, preferably the film hinge forms a mating component for the connection to the attachment. For example, with the upper form and lower form lying one upon the other, the attachment may be slid onto the film hinge. In so doing, in the final position, the attachment may enter into a snap-in connection with the film hinge. However, the snap-in connection may also be provided at the surfaces of the key case and the attachment adjoining one another.

The key case may have a standard opening into which an operating module is inserted. Moreover, the key case may include an accommodation for a standard board for electronic devices of the key unit. For example, the device for opening and closing the lock system may include a transmitter for the remote control of the lock system. In this case, preferably the electronic components of this transmitter are disposed on the standard board, which is accommodated by the key case. Further electronic components may also be provided on this standard board. Thus, the electronic functions of the key unit may be adapted in an inexpensive and uncomplicated manner, without it being necessary to alter the key case.

The device for opening and closing the lock system may alternatively or additionally include a mechanical key. The mechanical key may be accommodated by the key case in various manner, as described below.

The attachment may include a clip for fastening the key unit to another object. In this manner, for example, the key unit may be secured in a shirt pocket, preferably a part of the clip of the key unit remaining visible, so that emblems, symbols, etc., may be applied on this part.

The attachment may include an electronic interface. In addition, the attachment may include a storage medium, the interface in this case permitting transmission of data from an external device to the storage medium. For instance, a connection may be produced through the interface to a computer, a camera or a music playback device. For example, the interface may be a USB (Universal Serial Bus) connector.

The attachment may include a visible symbol which identifies the vehicle type belonging to the lock system. Alternatively or additionally, the symbol may also identify the vehicle manufacturer. Finally, the attachment may include a visible inscription for identifying the vehicle belonging to the lock system. For example, the identification may include the vehicle registration number.

The key unit may include a position-determining device for determining the position of the key unit and for determining the position of the vehicle belonging to the lock system. In particular, the attachment may contain the position-determining device. It may include a satellite positioning system like the GPS (Global Positioning System), for instance. Preferably, the key unit, especially the attachment of the key unit, has a display which is connected to the position-determining device, so that it is possible to display a digital map and/or direction markings for finding the vehicle belonging to the lock system.

The surface of the key case adjacent to the attachment may have an opening of a battery compartment. This opening is not visible when the key case is joined to the attachment. For example, the opening may be closed by a rubber plug that is joined to the key case by a tab.

According to example embodiments of the present invention, a key unit is provided for a lock system of a vehicle, having a key case whose width is greater than its height or thickness, and further having a swing-out key which is swing-mounted in the key case. In the key unit, according to this aspect, the swivel axis of the key extends in the direction of the width of the key case. Preferably, the key includes a key body, to which a key shank is attached. The key body is swing-mounted in a cutout in the end face of the key case, so that the key body is visible on two sides of the key unit facing away from each other. Thus, the cutout extends over the entire thickness of the end face.

The cutout in the end face of the key case may change into an accommodation space for the key shank, which is formed in the bottom side of the key unit. Preferably, the cutout in the end face of the key case and the accommodation space for the key shank are centrally located with respect to the width of the key case. Thus, in the position of the mechanical key when not in use, it is accommodated by the accommodation space of the key case in the middle in the bottom side of the key unit, the key body being visible both from the bottom side and from the top side of the key unit.

The swing-out key may bear an emblem, especially the logo of the vehicle manufacturer. In particular, the key body may bear the emblem. Preferably, it is visible from the side of the key case facing away from the side having the accommodation space for the key shank, i.e., the emblem is visible from the top side of the key unit. The emblem may be placed on both sides of the key body, so that it is visible both from the top side and from the bottom side.

The key, when in its position of non-use in which the key shank is located in the accommodation space of the key case, may be safeguarded against swinging out, and may be releasable by a release mechanism disposed on the swivel axis.

According to example embodiments of the present invention, a key unit is provided for a lock system of a vehicle, having an elongated key case in which an elongated flat key, whose width is greater than its thickness, is secured in a manner allowing it to swivel. In its position when not in use, the flat key is retracted in an accommodation space in a lateral surface of the key case. In the key unit, the swivel axis of the flat key extends in the direction of the width of the flat key, i.e., the accommodation space for the flat key in the lateral surface of the key case has a depth which corresponds to the thickness of the flat key, and a width which corresponds to the width of the flat key. Upon the swinging out of the flat key, an imaginary plane, which is defined by the long side and broad side of the flat key, is swiveled about the swivel axis. Such a key unit has the advantage that the accommodation space of the key case for the flat key may be very flat.

According to example embodiments of the present invention, a key unit is provided for a lock system of a vehicle, having a transmitter for the remote control of the lock system and having an operating module that has one or more operating fields for controlling the transmitter. In the key unit, the operating field or operating fields is/are recessed in the key unit.

The key unit may include an elongated key case which accommodates the transmitter and the operating module. On the surface of the key case on which the operating key or keys are able to be manipulated, at least one rib is formed in each case outside in the lengthwise direction, which rise above the operating key or keys in the direction of the normal of this surface. Thus, the ribs run on the right and left side of the operating keys of the operating module. Therefore, in the key unit, the operating keys are effectively prevented from being operated unintentionally, e.g., when stored in a pocket.

According to example embodiments of the present invention, a key unit is provided for a lock system of a vehicle, having a transmitter for the remote control of the lock system and having an operating module which has a plurality of operating fields for controlling the transmitter, the haptics of the surfaces of the operating fields differing. The surfaces of the operating fields differ in particular with respect to the tactile perception of a user. For instance, the operating fields may differ with regard to their roughness. Moreover, the surfaces of the operating fields may be made of different materials. In this manner, the functions of the operating fields may easily be felt without a visual observation of the operating fields being necessary. In this context, the different haptics of the surfaces of the operating fields go beyond simple projections and depressions, which are formed by symbols.

It is pointed out that the various developments and further refinements of the different aspects of the key unit may be combined among one another as desired. Thus, for example, it is possible that the type of support of the key in the key unit according to the second and third aspects described above may be used in the key unit with the attachment. In like manner, the variously formed attachments from the first aspect may also be used in the case of key units according to the further aspects. Moreover, the formations of the operating fields and the ribs of the key case according to the fourth and fifth aspects may also be utilized in the case of the key unit according to the first, second or third aspect.

Example embodiments of the present invention are explained in more detail below with reference to the appended Figures.

DETAILED DESCRIPTION

Identical components or component sections have the same numbering in all figures.

A key unit according to example embodiments of the present invention is described with reference to FIG. 1 to 4.

The key unit has a modular design. This modular design includes a key case 1 and an attachment 2 which is joined to key case 1. The modular design also has a standard board 7 and an operating module 8 which are accommodated by key case 1.

Figure 1:
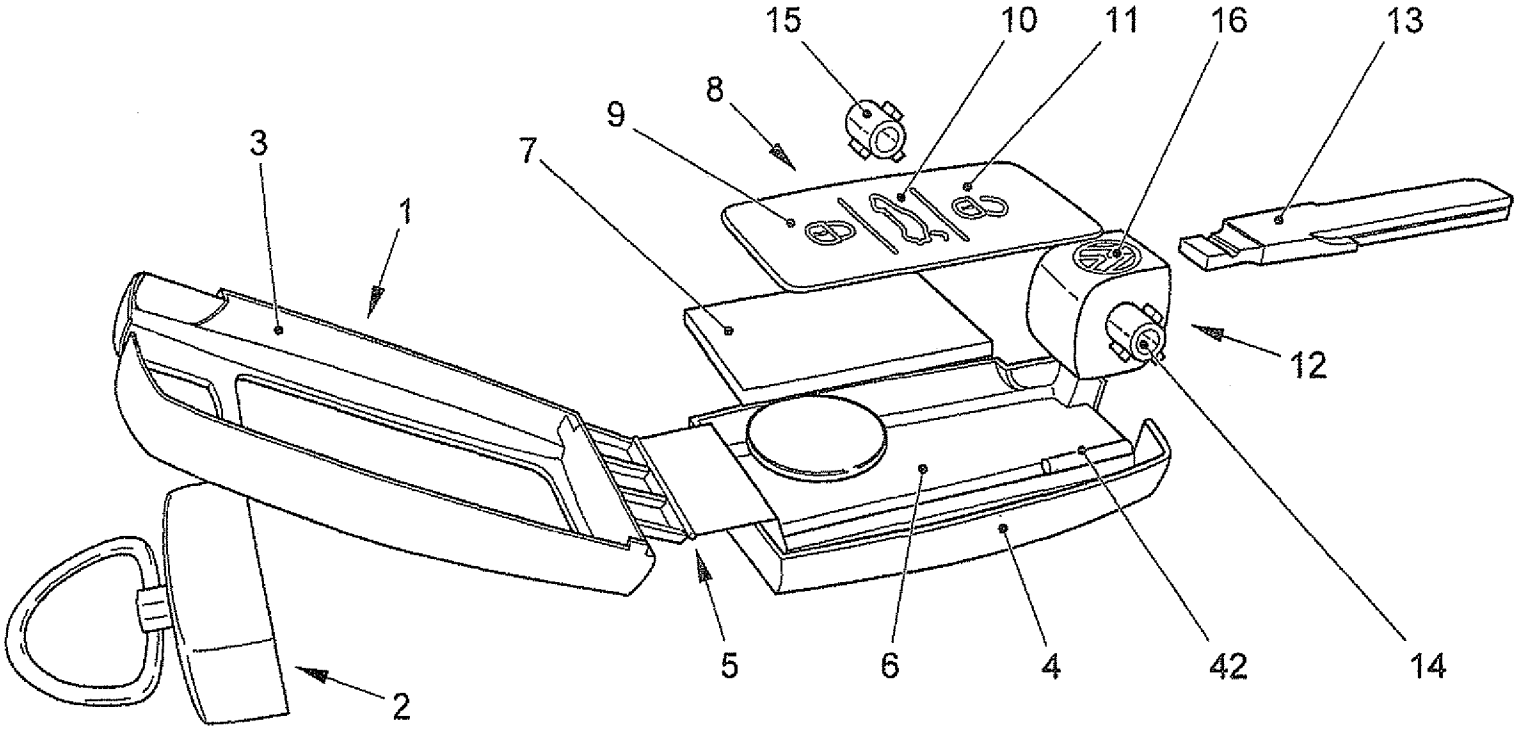
FIG. 1 shows an exploded view of the key unit according to example embodiments of the present invention.

Key case 1 is produced from a plastic part which may be manufactured in a single tool by injection molding. It is thus formed in one piece, an upper form 3 and a lower form 4 being joined to each other by a film hinge 5. FIG. 1 shows the upper form and lower form in a swung-open state.

Key case 1 has an accommodation 6 for standard board 7. Standard board 7 may include various electronic elements of the key unit. It may be adapted to the desired embodiment of the key unit, in doing which, however, the same board dimensions always being used.

Disposed on standard board 7 are the electronic components of a transmitter, known per se, for the remote control of the lock system belonging to the key unit. Such electronic lock systems are generally known. The transmitter includes a radiation source 42, in particular an infrared diode, which is located in the front side of the key unit and which is able to emit coded signals for controlling the lock system.

Standard board 7 is assigned an operating module 8 which may include a plurality of operating fields 9, 10, 11 in the form of push buttons, for instance. The transmitter for the remote control of the lock system of the vehicle may be controlled by operating fields 9 through 11 of operating module 8. In the example shown in FIG. 1, operating module 8 includes an operating field 9 for the remote-controlled closing of an assigned lock system of a vehicle, an operating field 10 for opening the lock of the vehicle trunk and an operating field 11 for the remote-controlled opening of the assigned lock system.

Figure 9:
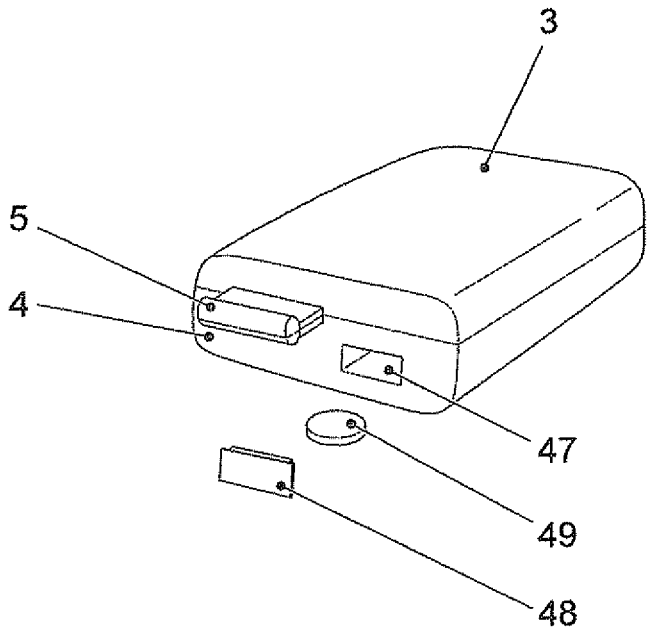
FIG. 9 shows the placement of a battery compartment for a key unit according to example embodiments of the present invention.

The surface of key case 1 adjacent to attachment 2 has an opening 47, shown in FIG. 9, of a battery compartment. After insertion of a battery 49, preferably in the form of a button cell, the opening is closable by a rubber plug 48 which, for example, is joined to key case 1 by a tab. When attachment 2 is put on the key case, opening 47 and rubber plug 48 are no longer visible.

The key unit also includes a mechanical key, which is accommodated by key case 1 in a manner allowing it to swivel. Such swiveling mechanical keys are known per se. However, it is also possible to use supports for the key as are described in the further exemplary embodiments.

In the example shown in FIG. 1, the mechanical key includes a key body 12, to which a key shank 13 is attached, that may be inserted into a lock cylinder of the lock system of the vehicle in order to open the corresponding lock. Key body 12 has a shaft 14, via which key body 12 is swivel-mounted in key case 1. The key may be snapped into place in specific swivel positions, particularly in the use position, and thus safeguarded. To release the swivel position of the key, a release mechanism 15 is provided which is coupled to key body 12. Applied on key body 12 is an emblem or symbol 16 which is visible both when the key is retracted and when it is swung out.

Key case 1 may be joined to an attachment 2 when upper and lower forms 3, 4 of key case 1 rest one upon the other in the assembled state. In this case, film hinge 5 forms a mating component for mounting attachment 2.

Figure 2A:
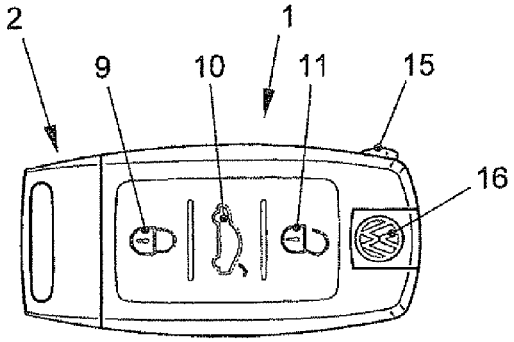
FIG. 2A to 2F show various views of the key unit according to example embodiments of the present invention.
Figure 2E:
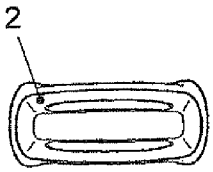
Figure 2B:
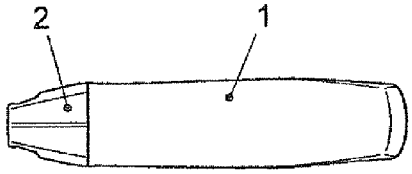
Figure 2F:
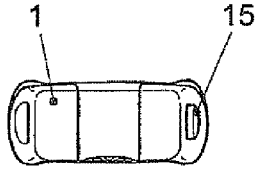
Figure 2C:
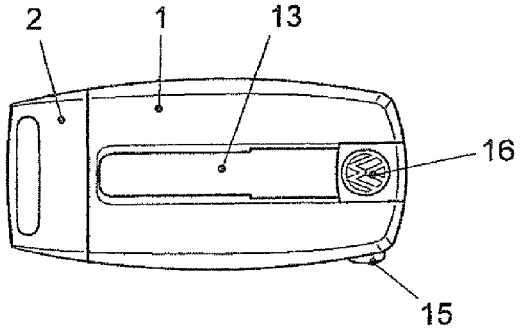
Figure 2D:
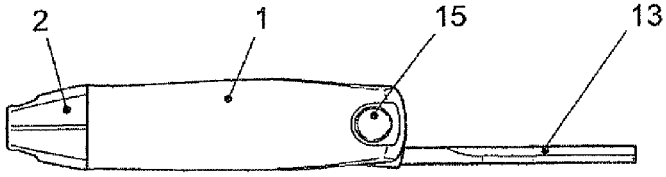

FIG. 2A to 2F show views of the modular-constructed key unit. FIG. 2A shows the top side of the key unit, from which operating fields 9 through 11 are able to be manipulated, and from which emblem 16, which is applied on key body 12, is visible when the key is in the retracted state, that is, in a position when not in use. FIG. 2B shows one lateral surface of the key unit, FIG. 2D shows the other lateral surface of the key unit in which release mechanism 15 is situated. FIG. 2D shows the key unit with swung-out key when the key is in the use position. FIG. 2C shows the bottom side of the key unit in which shank 13 of the key is accommodated in lower form 4. An emblem 16, which is applied on key body 12, is visible from this side, as well. FIG. 2E shows the rear face of the key unit, where attachment 2 is joined to key case 1. Finally, FIG. 2F shows the front face of key case 1, which has a cutout in the center for accommodating key body 12.

Figure 3D:
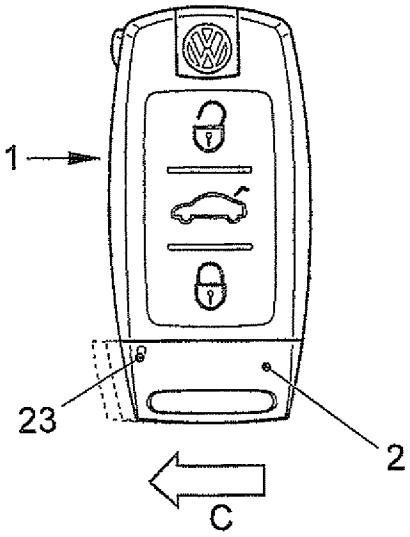
FIG. 3A to 3D illustrate the mounting of the attachment on the key case of the key unit according to example embodiments of the present invention and its release.

The joining of attachment 2 to key case 1 is explained with reference to FIG. 3A to 3D. Attachment 2 has a cavity into which film hinge 5, as shown in FIG. 3A, may be inserted. In so doing, attachment 2 is moved in the direction of arrow A toward key case 1 until the respective end faces abut against each other. Thereupon, attachment 2 is moved in the direction of arrow B, as shown in FIG. 3B, until a snap-in connection is produced between attachment 2 and key case 1. For this snap-in connection, the key case has suitable snap-in locking elements, for example, at film hinge 5 or at upper or lower form 3, 4, as well as in the cavity of attachment 2.

Figure 3C:
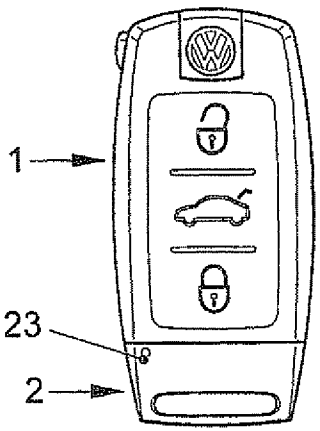
Figure 3B:
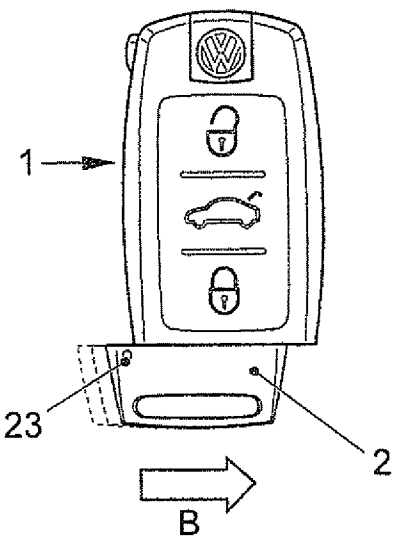
Figure 3A:
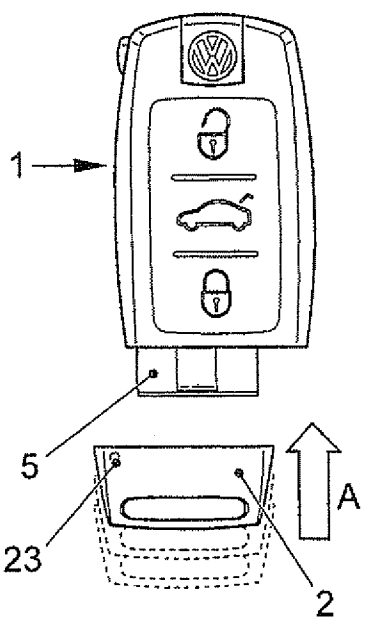

FIG. 3C shows the state in which attachment 2 is joined to key case 1. In this case, the surface of key case 1 merges into the surface of attachment 2. That is to say, attachment 2 is joined in alignment with key case 1. In addition, attachment 2 is joined in rotatably fixed manner to key case 1. The respective end faces abut against each other. Since attachment 2 completely accommodates film hinge 5 of key case 1, the strain whitening developing during the injection molding is not visible.

An opening 23 is provided in attachment 2. For example, if a ballpoint pen or another pointed object is introduced into this opening 23, it is possible to release the snap-in connection between attachment 2 and key case 1, so that attachment 2 may be shifted in the direction of arrow C, as shown in FIG. 3D. In this manner, it is possible to remove attachment 2 from key case 1.

Figure 4C:
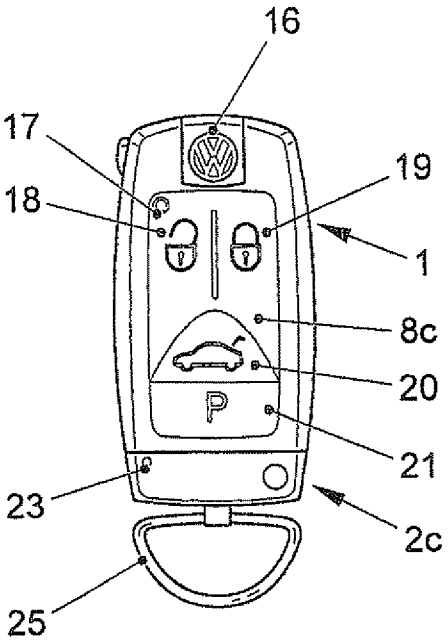
FIG. 4A to 4I show different variants of the key unit according to example embodiments of the present invention.
Figure 4B:
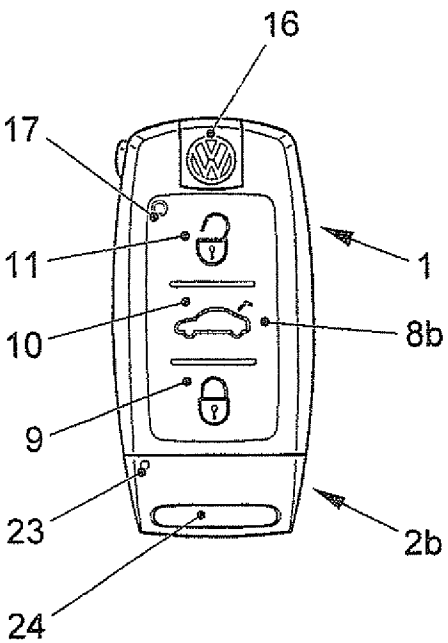
Figure 4A:
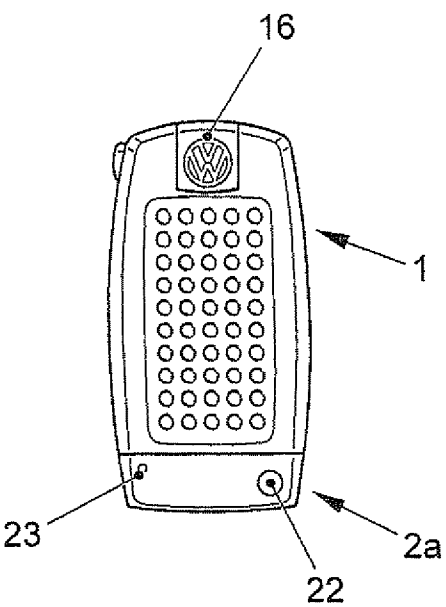

FIG. 4A to 4I show different variants able to be realized based on the modular design of the key unit. They are explained in the following:

FIG. 4A shows a basic key unit without electrification. Instead of operating module 8, only a plastic part is used. Attachment 2*a* is made of plastic and has a ring eye 22.

FIG. 4B shows a standard key unit with electrification. Operating module 8*b* includes operating fields 9, 10 and 11 for opening and closing a door lock, as well as for opening a trunk lid. Operating module 8*b* also includes a light-emitting diode 17, by which a status indicator is made available. Attachment 2*b* is made of plastic and has an elongated ring eye 24.

FIG. 4C shows a further standard key unit with electrification. Operating module 8*c* includes a total of four function keys 18, 19, 20 and 21. The door lock is able to be opened and closed by momentary-contact switches 18 and 19. The trunk may be opened by momentary-contact switch 20. Finally, momentary-contact switch 21 takes the form of what is referred to as a panic button. Attachment 2*c* is made of metal and has a key ring 25.

Figure 4F:
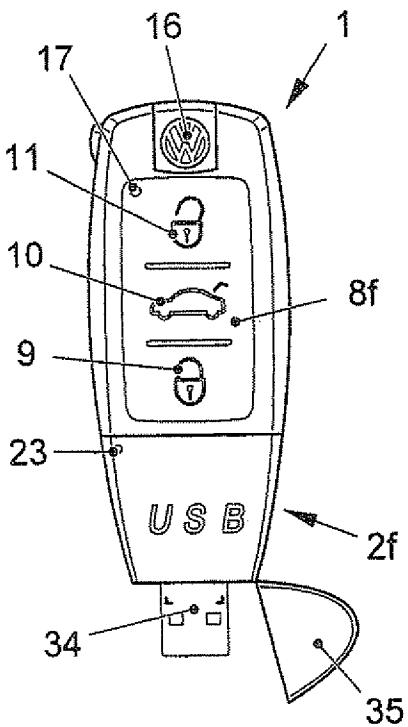
Figure 4E:
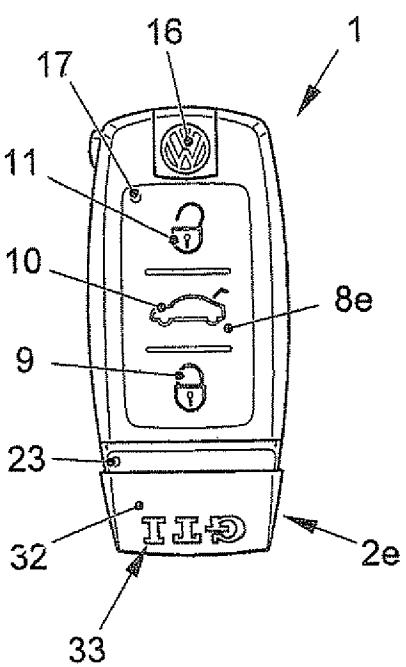
Figure 4D:
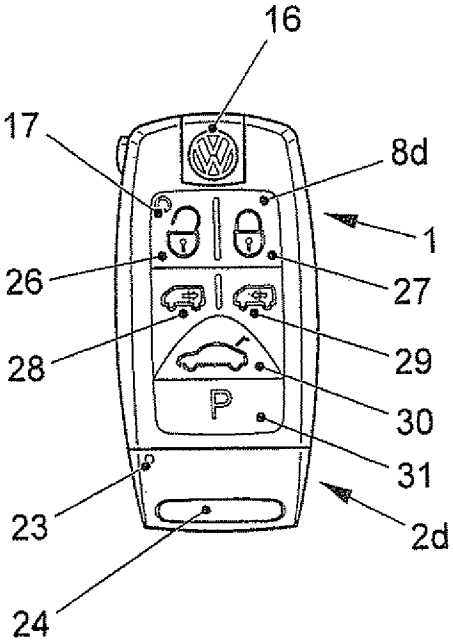

FIG. 4D shows a full-function key unit with electrification. Operating module 8*d* includes a total of six function keys which, in addition to the four function keys of the key unit shown in FIG. 4C, includes two momentary-contact switches 28 and 29 for opening and closing a sliding door. Attachment 2*d* is made of metal and has a ring eye 24 which corresponds to the ring eye of the embodiment shown in FIG. 4B.

FIG. 4E shows an individualized standard key unit with electrification. Operating module 8*e* corresponds to the operating module shown in FIG. 4B. The attachment is made of metal. It includes a clip 32 by which the key unit may be secured in a shirt pocket, for instance. If the key unit is slipped into a shirt pocket, for example, and clipped onto the edge, a vehicle-specific identification 33 is visible, which is applied on attachment 2*e*. This key unit may be used in particular for various specialty models of a vehicle.

FIG. 4F shows a standard key unit having a functional expansion. Operating module 8*f* corresponds to operating module 8*b* shown in FIG. 4B. Attachment 2*f* contains a data-storage medium and a USB connector 34 which is used as an interface to other electronic devices. USB connector 34 may be covered by a cap 35. For example, data from other electronic devices may be transmitted via USB connector 34 and stored on the storage medium of attachment 2*f*. The storage medium may be a mini hard disk, for instance, or a flash memory.

Figure 4I:
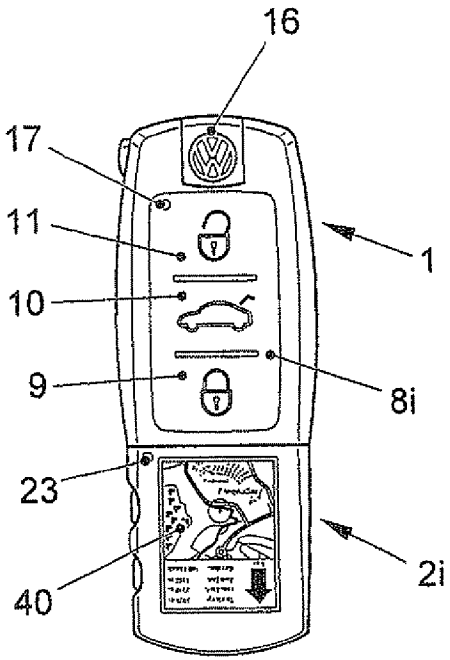
Figure 4H:
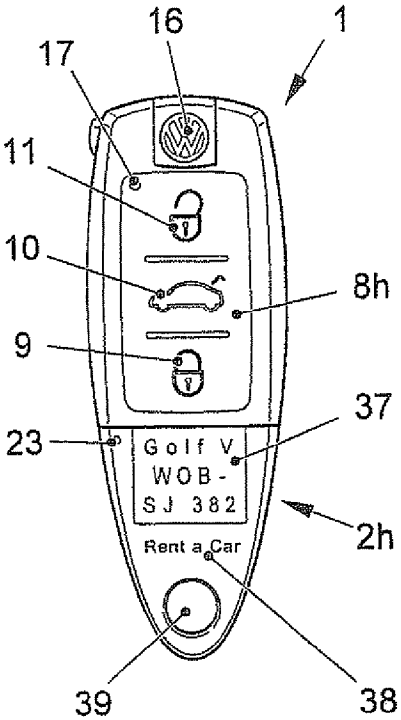
Figure 4G:
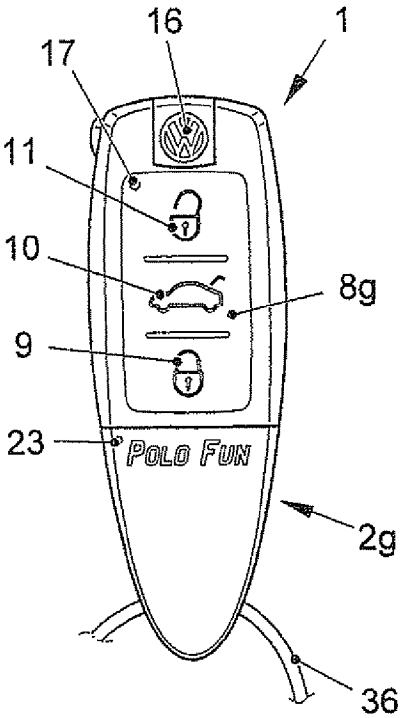

FIG. 4G shows a further key unit in which attachment 2*g* has a form different from the previous attachments. A cord 36 may be threaded into it, so that the key unit may be worn around the neck.

FIG. 4H shows a standard key unit having a functional expansion, e.g., for corporate clients having a vehicle fleet.

Operating module 8*h* corresponds to operating module 8*b*. Attachment 2*h* has a field 37 in which the appertaining vehicle type and, to identify the vehicle, the registration number are applied. A logo 38 of the corporate client may also be applied. Finally, the attachment has a ring eye 39.

FIG. 4I shows a standard key unit with electrification having an attachment 2*i* with an additional function. Operating module 8*i* corresponds to operating module 8*b*. Attachment 2*i* includes a position-determining device, by which both the position of the key unit as well as the position of the vehicle belonging to the corresponding lock system may be determined. For example, the position of the key unit may be ascertained with the aid of what is called a GPS module. Upon locking the associated vehicle, the position of the vehicle may be stored in a memory in attachment 2*i*, for instance, and later read out from there. Attachment 2*i* also has a display 40, by which the route to the vehicle may be displayed.

Figure 5A:
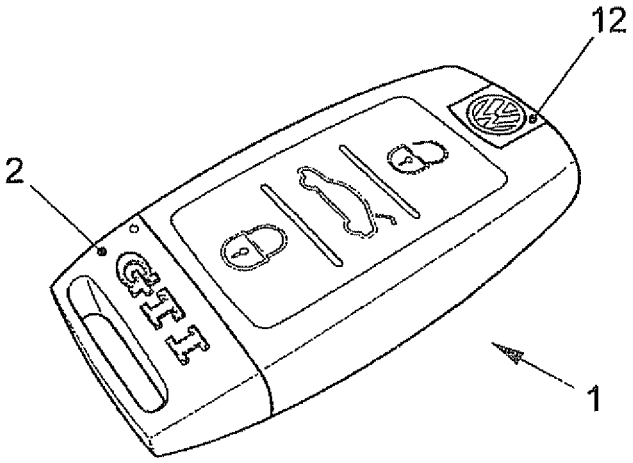
FIGS. 5A and 5B show the top side and the bottom side with swung-out key of a further exemplary embodiment of the key unit.
Figure 5B:
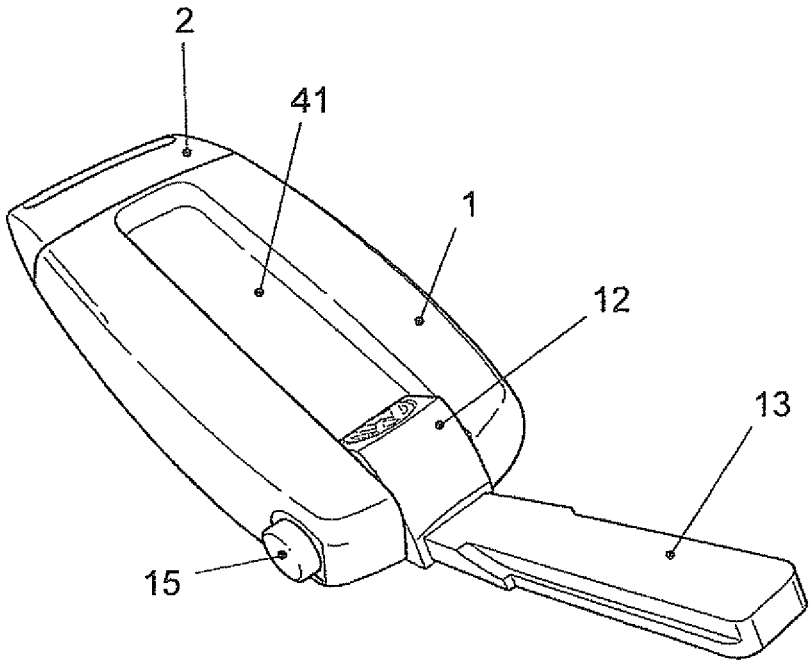

An exemplary embodiment of the present invention is explained with reference to FIGS. 5A and 5B. The key unit includes an elongated key case 1, whose width is greater than its height or thickness. In key case 1, a swing-out mechanical key is swing-mounted such that the swivel axis of the key, as shown in FIG. 5B, extends in the direction of the width of key case 1.

The key includes a key shank 13, by which the lock cylinder of one or more locks of a lock system of a vehicle may be opened. Key shank 13 is attached to a key body 12, which is swing-mounted in key case 1. To that end, a cutout is formed centrally in the front end of key case 1. Key body 12 is inserted into this cutout such that a shaft, about which the key may be swiveled, engages on both sides in the lateral surfaces of the cutout. The cutout in key case 1 extends over the entire thickness of the key unit, so that key body 12 is visible both on the top side of the key unit shown in FIG. 5A and on the bottom side shown in FIG. 5B. Thus, an emblem may be applied on key body 12, the emblem being visible from both sides of the key unit.

The cutout in the end face of key case 1 changes over into an accommodation space 41 for key shank 13. This accommodation space 41 is formed centrally in the bottom side of the key unit. In its position when not in use, the key is in a swivel position such that key shank 13 is located completely in accommodation space 41, key shank 13 terminating flush with the surface of the bottom side of key case 1. In this not-in-use position, the key is safeguarded from swinging out. The key is able to be released by a release mechanism 15 disposed on the swivel axis, e.g., by pressing release mechanism 15 in the direction of key body 12. The key may then be swiveled by approximately 180°. In this use position, it is able to be safeguarded again. The release may again be effected via release mechanism 15.

In particular, key shank 13 is a flat key whose width is greater than its thickness. As shown in FIG. 5B, the direction of the width of the flat key corresponds to the direction of the width of key case 1. Therefore, the swivel axis of the key extends in the direction of the width of key shank 13.

As in the first described exemplary embodiment, the key unit of the second described exemplary embodiment may have a modular design. In particular, key case 1 shown in FIGS. 5A and 5B corresponds to key case 1 in FIG. 1 to 4. Any attachments 2 as desired may be coupled to this key case 1, as was described in the first described exemplary embodiment. In like manner, the further details of the first described exemplary embodiment, like operating module 8 having the corresponding momentary-contact switches, may also be integrated into the key unit of the second described exemplary embodiment, and in this manner form further refinements of the second described exemplary embodiment.

Figure 8:
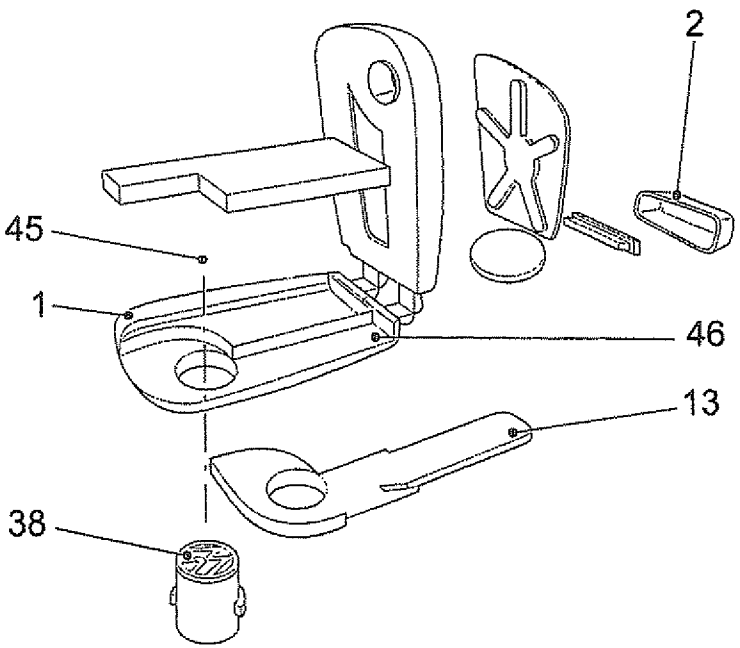
FIG. 8 shows an exploded view for the exemplary embodiment according to FIG. 7 of the key unit.

An exemplary embodiment (see FIGS. 7 and 8) differs from the second described exemplary embodiment only with respect to the support of the key. The key is in the form of an elongated flat key, whose width is greater than its thickness. This flat key is swing-mounted in the key case. In contrast to the second described exemplary embodiment, however, swivel axis 45 does not extend in the direction of the width of key case 1, but rather in the direction of the height or thickness of the key case, so that in the use position of key shank 13 of the flat key, its proportions are oriented like those of key case 1. In addition, the swivel axis is located in a corner of the key case, so that the flat key is retracted in an accommodation space in a lateral surface of the key case.

The flat key is aligned relative to the key case such that the swivel axis of the flat key extends in the direction of the width of the flat key. The flat key is therefore disposed in a manner rotated by 90° with respect to the orientation shown in FIG. 5B, and is swiveled around a corner of the end face of the key case until it is received by an accommodation space in the lateral surface of the key case. The depth of this accommodation space 46, implemented as a slot accommodation, in the lateral surface corresponds therefore to the thickness of key shank 13.

Figure 7:
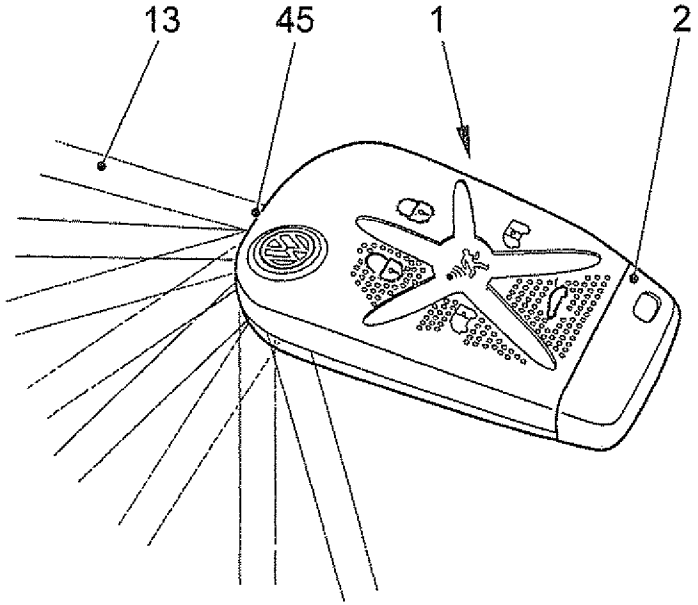
FIG. 7 shows a further exemplary embodiment of the key unit.

With the orientation of key shank 13 according to FIGS. 7 *and* 8, key slots for locks may also be disposed extended horizontally, without the view of the operating fields thereby getting lost when using the key. Consequently, new starting points with regard to ergonomics and appearance are obtained, for example, for the design of door locks or ignition locks.

The further refinements of the key unit of the third described exemplary embodiment may correspond to those of the first and—except for the orientation of the key—to those of the second described exemplary embodiment. In particular, the key unit of the third exemplary embodiment may also have a modular design, so that different attachments are able to be secured to the key case.

Figure 6:
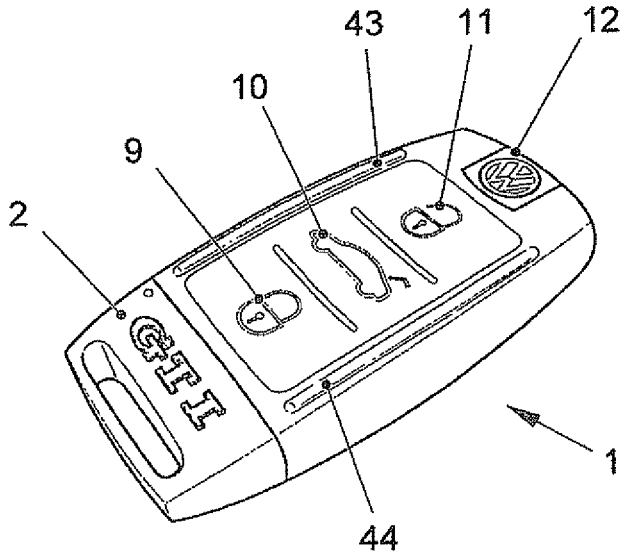
FIG. 6 shows another exemplary embodiment of the key unit.

The key unit of an exemplary embodiment is shown in FIG. 6. It includes a transmitter, known per se, for the remote control of a lock system of a vehicle, and an operating module, known per se, having one or more operating fields for controlling the transmitter. In the exemplary embodiment of FIG. 6, an operating module is shown, having three operating fields 9, 10 and 11 taking the form of momentary-contact switches. Operating fields 9 through 11 are disposed in a key case 1 such that they are recessed. Inadvertent actuation of operating fields 9 to 11 is thereby prevented.

Moreover, situated laterally in the lengthwise direction of elongated key case 1 are ribs 43 and 44 which rise above operating fields 9 to 11 in the direction of the normal of the top side of key case 1 on which operating fields 9 to 11 are manipulable. Ribs 43 and 44 are therefore situated laterally next to operating fields 9 to 11.

The further details of the key unit of the fourth described exemplary embodiment may correspond to those of the first three exemplary embodiments. In particular, various attachments 2 may be joined to key case 1, as was described in the first described exemplary embodiment. Furthermore, key case 1 may include a mechanical key which, as described in the second or third described exemplary embodiment, is secured in key case 1.

Like the key unit of the fourth described exemplary embodiment, the key unit of an exemplary embodiment has a transmitter, known per se, for the remote control of a lock system of a vehicle, as well as an operating module, known per se, which includes a plurality of operating fields, especially a plurality of momentary-contact switches, for controlling the transmitter. In the case of the key unit of the fifth described exemplary embodiment, the haptics of the surface of the operating fields differ from one another. Based on the different haptics, the user is able to differentiate the various operating fields by his/her sense of touch. In particular, the operating fields are perceived tactilely in various ways, that is, the contact of the operating fields with the skin is perceived differently. In this context, the different haptics are not achieved by elevations or depressions for visible symbols, but rather on the basis of a surface structure of a very much smaller order of magnitude. For example, the roughness of the surfaces of the operating fields may differ. In addition, different materials may be used for the operating fields.

The further refinements of the key unit of the fifth described exemplary embodiment may correspond to those of the first four exemplary embodiments. In particular, the key unit may have a modular design, in which a key case is joined to an attachment, as was described in the first described exemplary embodiment. Furthermore, a key may be supported in a key case, as described in the second or third described exemplary embodiment. Finally, as described in the fourth described exemplary embodiment, the operating fields may be recessed, and ribs may be disposed laterally next to the operating fields on the key case.

Figure 12:
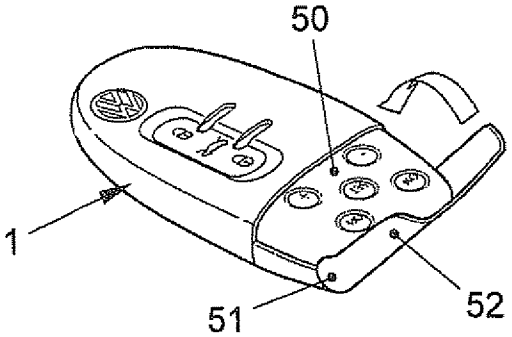
FIG. 12 shows the elements according to FIG. 11 after assembly.
Figure 10:
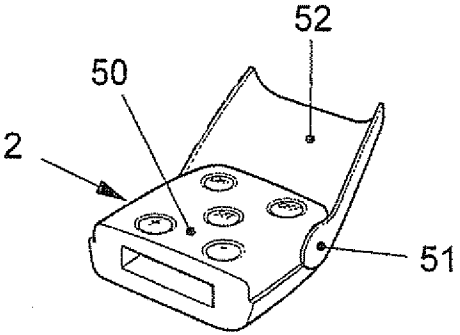
FIG. 10 shows an attachment having a keypad for a further variant of the key unit according to example embodiments of the present invention.
Figure 11:
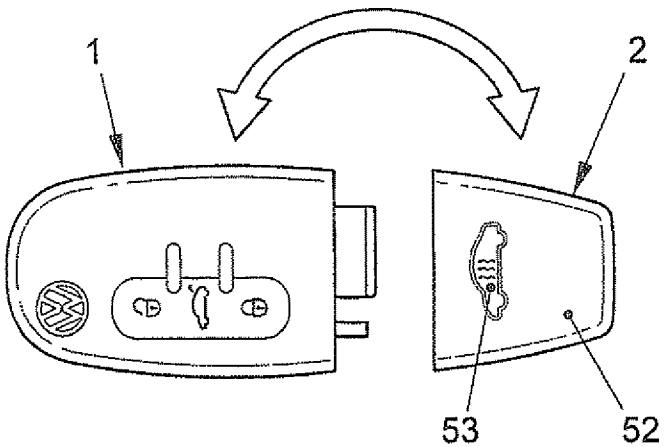
FIG. 11 shows a key unit having the attachment according to FIG. 11 prior to assembly.

In the exemplary embodiment shown in FIGS. 10 to 12, attachment 2 is equipped with a keypad 50, which here is a component of a remote control for an engine-independent heater of a vehicle. Keypad 50 is situated below a keypad cover 52, movable about a swivel axis 51, which in the representations in FIGS. 10 and 12, is in the open position, so that keypad 50 is accessible for the fingers of a vehicle user for input or switching purposes.

FIG. 11 shows keypad cover 52 in a closed position with an engine-independent heater symbol 53 on the side facing away from keypad 50. With this exemplary embodiment, the two operating components of vehicle key and remote control may be combined in extremely advantageous manner to form one operating device. The storage of two separate operating components, customary until now, may thus be eliminated with a considerable gain in convenience and assurance against loss.

Keypad 50 is also usable for other remote-control purposes. For example, remote controls for garages or gate openers are possible. However, keypad 50 may also be a component of a telecommunications device with which it is connected, e.g., via Bluetooth technology. A transmitter device for the signals triggered at keypad 50 may be assigned alternatively to attachment 2 or to key case 1. To further simplify the design, the use of the same transmitter device is provided for both functions, thus, vehicle locking and unlocking on one hand, and remote control on the other hand. To supply both systems with electrical energy, both attachment 50 and key case 1 are each assigned a rechargeable accumulator—e.g., a storage battery or capacitor—which optionally are also connectable to each other via a plug connector system.

LIST OF REFERENCE CHARACTERS

1 Key case
2 Attachment
3 Upper form
4 Lower form
5 Film hinge
6 Standard-board accommodation
7 Standard board
8 Operating module
9 Operating field
10 Operating field
11 Operating field
12 Key body
13 Key shank
14 Shaft
15 Release mechanism
16 Emblem
17 Light-emitting diode for a status indicator
18 Operating field
19 Operating field
20 Operating field
21 Operating field
22 Ring eye
23 Opening for the release of the attachment
24 Ring eye
25 Key tag
26 Operating field
27 Operating field
28 Operating field
29 Operating field
30 Operating field
31 Operating field
32 Clip
33 Vehicle-specific identification
34 USB connector
35 Cap
36 Cord
37 Field for vehicle type and registration number
38 Logo

39 Ring eye
40 Display
41 Accommodation space
42 Radiation source for transmitter
43 Rib
44 Rib
45 Swivel axis
46 Accommodation space
47 Opening for a battery compartment
48 Rubber plug
49 Battery
50 Keypad
51 Swivel axis
52 Keypad cover
53 Engine-independent heater symbol

What is claimed is:

1. A key unit for a lock system of a vehicle, comprising:
a device adapted to open and close the lock system;
and a modular arrangement including a key case and an attachment, the key case accommodating the device and the attachment releasably joined to the key case;
wherein the attachment includes a position-determination device adapted to determine a position of the key unit, to determine a position of the vehicle belonging to the lock system, and to store the position of the vehicle in a memory of the position-determination device.

2. The key unit according to claim 1, wherein the attachment is joined in rotatably fixed manner to the key case.

3. The key unit according to claim 1, wherein the attachment is joined in alignment with the key case.

4. The key unit according to claim 1, wherein the key case and the attachment have surfaces adjacent to one another.

5. The key unit according to claim 1, wherein the attachment is secured to the key case by a snap-in connection.

6. The key unit according to claim 1, wherein the key case is formed in one piece.

7. The key unit according to claim 6, wherein the key case includes an upper portion and a lower portion joined to each other by a film hinge.

8. The key unit according to claim 7, wherein when the upper portion and the lower portion lie one upon the other, the film hinge forming a mating component for connection to the attachment.

9. The key unit according to claim 1, wherein the key case has a standard opening into which an operating module is inserted.

10. The key unit according to claim 7, wherein the attachment includes a clip adapted to secure the key unit to another object.

11. The key unit according to claim 1, wherein the key case includes an accommodation for a standard board for electronic devices of the key unit.

12. The key unit according to claim 1, wherein the device includes a transmitter adapted to remotely control the lock system.

13. The key unit according to claim 1, wherein the device includes a mechanical key.

14. The key unit according to claim 1, wherein the attachment includes an electronic interface.

15. The key unit according to claim 14, wherein the attachment includes a storage medium, and the interface is adapted to permit transmission of data from an external device to the storage medium.

16. The key unit according to claim 1, wherein the attachment includes a visible symbol that identifies a vehicle type belonging to the lock system.

17. The key unit according to claim 1, wherein the attachment includes a visible inscription adapted to identify the vehicle belonging to the lock system.

18. The key unit according to claim 1, wherein the key unit includes a display connected to the position-determination device.

19. The key unit according to claim 1, wherein a surface of the key case adjacent to the attachment has an opening of a battery compartment, the opening not being visible when the key case is joined to the attachment.

20. A key unit for a lock system of a vehicle, comprising:
a key case having a width greater than a height and a length greater than the width;
a bottom side of the key unit having an accommodation space, the bottom side extending in the direction of the width and length of the key case;
a swing-out key including a key body to which a key shank is secured, the key having a position of non-use in which the key shank is located in the accommodation space, and having a position of use in which the key is rotated about a swivel axis to extend in a direction of the length of the key case;
wherein the key is swing-mounted in the key case; and
wherein the swivel axis of the key extends in a direction of the width of the key case.

21. The key unit according to claim 20, wherein the key body is swing-mounted in a cutout in an end face of the key case, so that the key body is visible on two opposite sides of the key unit when in the position of non-use.

22. The key unit according to claim 21, wherein the cutout in the end face of the key case merges into the accommodation space for the key shank.

23. The key unit according to claim 22, wherein the cutout in the end face of the key case and the accommodation space for the key shank are arranged centrally with respect to the width of the key case.

24. The key unit according to claim 20, wherein the swing-out key bears an emblem.

25. The key unit according to claim 24, wherein a key body of the key bears the emblem.

26. The key unit according to claim 24, wherein the key, in the position of non-use, is safeguarded against swinging out, and is releasable by a release mechanism arranged on the swivel axis.

27. A key unit for a lock system of a vehicle, comprising:
an elongated flat key; and
an elongated key case in which the elongated flat key is swing-mounted, the flat key, in a position when not in use, being retracted in an accommodation space in a lateral surface of the key case, and a width of the flat key being greater than a thickness of the flat key and a length of the flat key being greater than the width of the flat key;
wherein a swivel axis of the flat key extends in a direction of the width of the flat key.

28. A key unit for a lock system of a vehicle, comprising:
a transmitter adapted to remotely control the lock system; and
an operating module including at least one operating field adapted to control the transmitter;
a modular arrangement including a key case and an attachment, the key case accommodating the transmitter and the operating module, and the attachment releasably joined to the key case;
wherein the at least one operating field is recessed in the key unit; and
wherein the attachment includes a position-determination device adapted to determine a position of the key unit, and to determine a position of the vehicle belonging to the lock system, and to store the position of the vehicle in a memory of the position-determination device.

29. The key unit according to claim 28, wherein on a surface of the key case on which the operating fields are manipulable, at least one rib is formed on an outside in a lengthwise direction, the ribs rising above the operating fields in a direction of a normal of the surface.

30. A key unit for a lock system of a vehicle, comprising:

a transmitter adapted to remotely control the lock system;

an operating module having a plurality of operating fields adapted to control the transmitter;

a modular arrangement including a key case and an attachment, the key case accommodating the transmitter and the operating module, and the attachment releasably joined to the key case; wherein haptics of a surface of the operating fields differ;

wherein the attachment includes a position-determination device adapted to determine a position of the key unit, to determine a position of the vehicle belonging to the lock system, and to store the position of the vehicle in a memory of the position-determination device.

31. The key unit according to 30, wherein the surfaces of the operating fields differ with respect to roughness.

32. The key unit according to 30, wherein the surfaces of the operating fields are made of different materials.

33. A key unit for a lock system of a vehicle, comprising:

an elongated flat key;

an elongated key case in which the elongated flat key is swing-mounted, the flat key, in a position when not in use, being retracted in an accommodation space in a lateral surface of the key case, and a width of the flat key being greater than a thickness of the flat key, a modular arrangement including the key case and an attachment, the attachment releasably joined to the key case;

wherein a swivel axis of the flat key extends in a direction of a height of the flat key, in a use position of the flat key, proportions of a key shank of the key and the key case have substantially a same orientation, the accommodation space being formed by a slot accommodation on a long side of the key case, into which the key shank is swivelable; and wherein the attachment includes a position-determination device adapted to determine a position of the key unit and to determine a position of the vehicle belonging to the lock system.

34. A key unit for a lock system of a vehicle, comprising:

a device adapted to open and close the lock system; and a modular arrangement including a key case and an attachment, the key case accommodating the device and the attachment releasably joined to the key case;

wherein the attachment is assigned a keypad, the key unit including a keypad cover retained on the attachment, the keypad cover adapted to cover the keypad;

wherein the attachment includes a position-determination device adapted to determine a position of the key unit, to determine a position of the vehicle belonging to the lock system, and to store the position of the vehicle in a memory of the position determination device.

35. The key unit according to claim 34, wherein the keypad is a component of a remote-control device.

36. The key unit according to claim 35, wherein the remote-control device includes at least one of (a) an engine-independent heater of a vehicle, (b) a garage opener, (c) a gate opener, and (d) a telecommunications device.

* * * * *